US007748430B1

(12) United States Patent
Hung

(10) Patent No.: US 7,748,430 B1
(45) Date of Patent: Jul. 6, 2010

(54) WINDOW COVERING WITHOUT NEEDING A LIFT CORD

(75) Inventor: Tien-Szu Hung, 32, Lane 670, Sec. 1, Zhangshui Rd., Sihu Township, Changhua County (TW)

(73) Assignees: Ching Feng Home Fashions Co., Ltd., Changhua Hsien (TW); Tien-Szu Hung, Changhua County (TW)

( * ) Notice: Subject to any disclaimer, the term of this patent is extended or adjusted under 35 U.S.C. 154(b) by 202 days.

(21) Appl. No.: 12/025,011

(22) Filed: Feb. 2, 2008

(51) Int. Cl.

| | |
|---|---|
| ***A47H 5/00*** | (2006.01) |
| ***E06B 9/21*** | (2006.01) |
| ***E06B 3/48*** | (2006.01) |
| ***E06B 3/94*** | (2006.01) |
| ***E06B 9/06*** | (2006.01) |

(52) U.S. Cl. ..... 160/168.1; 160/84.05

(58) Field of Classification Search ..... 160/166.1, 160/168.1 R, 170, 171, 173 R, 178.1 R, 84.01, 160/84.04, 84.05; 16/DIG. 41, 422

See application file for complete search history.

(56) References Cited

U.S. PATENT DOCUMENTS

| | | | | |
|---|---|---|---|---|
| 2007/0039696 | A1* | 2/2007 | Strand et al. | 160/84.04 |
| 2007/0079476 | A1* | 4/2007 | Cheng | 16/110.1 |
| 2007/0084567 | A1* | 4/2007 | Chen | 160/84.05 |
| 2008/0083509 | A1* | 4/2008 | Hsu et al. | 160/84.05 |

* cited by examiner

*Primary Examiner*—Katherine W Mitchell
*Assistant Examiner*—Jeremy C Ramsey
(74) *Attorney, Agent, or Firm*—Alan Kamrath; Kamrath & Associates PA

(57) ABSTRACT

A window covering includes a headrail, a retractable shading member having an upper end mounted on the headrail, a bottom rail having an upper end mounted on a lower end of the shading member, and a pull bar having an upper end removably mounted on a lower end of the bottom rail. Thus, the pull bar is combined with the bottom rail to drive the bottom rail to push the shading member upward or pull the shading member downward to fold or expand the shading member so that the window covering needs not to provide a lift cord to push or pull the shading member so as to provide a safety function. In addition, the pull bar can be detached from the bottom rail when not in use, thereby enhancing the aesthetic quality of the window covering.

4 Claims, 5 Drawing Sheets

WINDOW COVERING WITHOUT NEEDING A LIFT CORD

BACKGROUND OF THE INVENTION

1. Field of the Invention

The present invention relates to a window covering and, more particularly, to a window covering that is expandable downward and retractable upward in a vertical direction.

2. Description of the Related Art

A conventional window covering, such as a Venetian blind, roman shade and the like, usually comprises a lift cord to expand or fold the window covering. However, the lift cord depends from a side of the window covering so that the lift cord is easily tangled with a child's neck, thereby causing danger to the child. In addition, the lift cord protrudes outwardly from the window covering, thereby decreasing the aesthetic quality of the window covering.

BRIEF SUMMARY OF THE INVENTION

In accordance with the present invention, there is provided a window covering, comprising a headrail, a retractable shading member having an upper end mounted on the headrail, a bottom rail having an upper end mounted on a lower end of the shading member, and a pull bar having an upper end removably mounted on a lower end of the bottom rail.

The primary objective of the present invention is to provide a window covering without needing a lift cord.

Another objective of the present invention is to provide a window covering, wherein the pull bar is combined with the bottom rail to drive the bottom rail to move upward or downward and to push the shading member upward or pull the shading member downward so as to fold or expand the shading member so that the window covering needs not to provide a lift cord to push or pull the shading member so as to provide a safety function.

A further objective of the present invention is to provide a window covering, wherein the pull bar can be detached from the bottom rail when not in use, thereby enhancing the aesthetic quality of the window covering.

A further objective of the present invention is to provide a window covering, wherein the pull bar is mounted on and detached from the bottom rail by rotation of the pull bar, so that the pull bar can be mounted on and detached from the bottom rail easily and quickly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
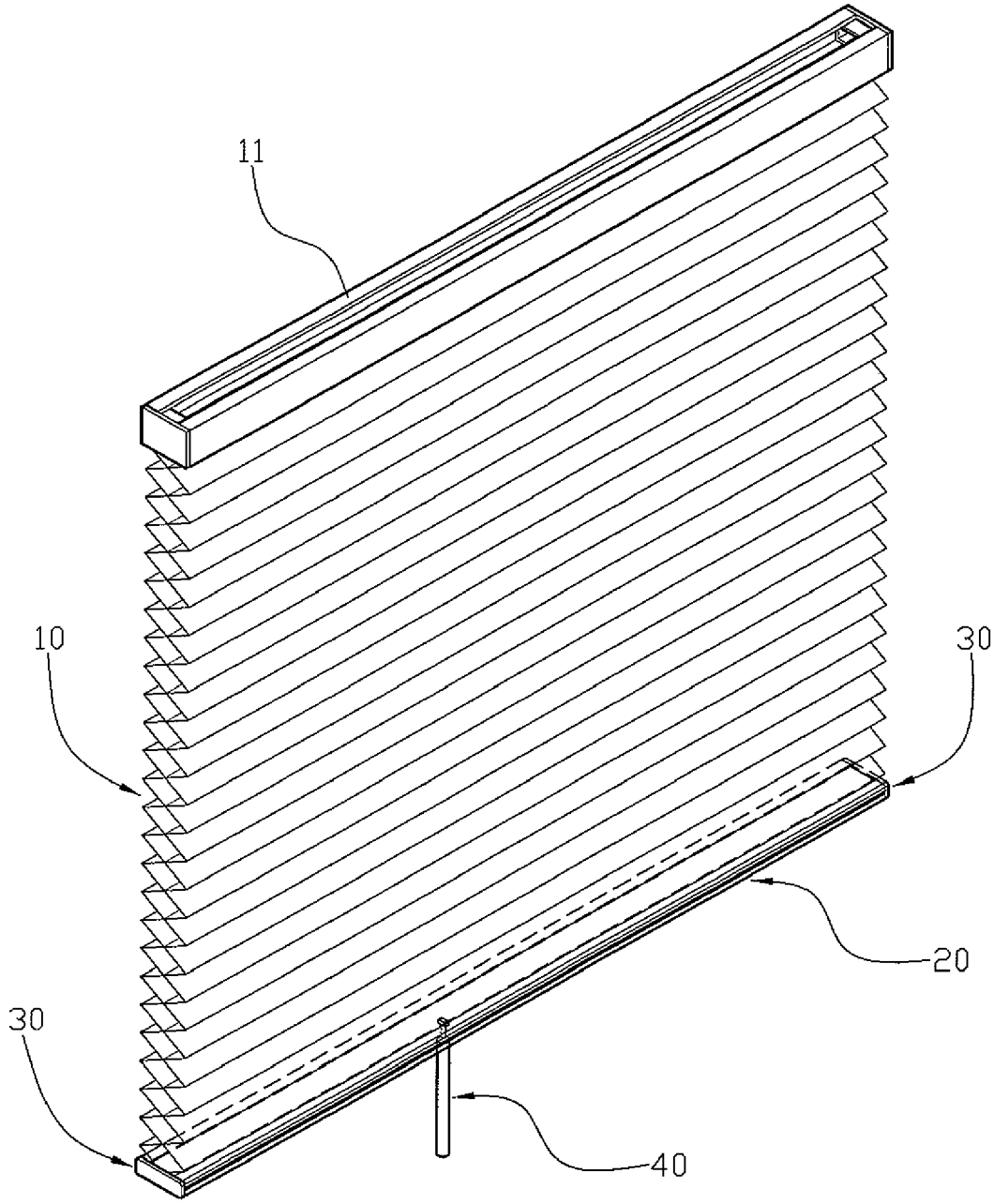
FIG. 1 is a perspective view of a window covering in accordance with the preferred embodiment of the present invention.

Referring to the drawings and initially to FIGS. 1-5, a window covering in accordance with the preferred embodiment of the present invention comprises a headrail 11, a retractable shading member 10 having an upper end mounted on the headrail 11, a bottom rail 20 having an upper end mounted on a lower end of the shading member 10, and a pull bar 40 having an upper end removably mounted on a lower end of the bottom rail 20.

The headrail 11 is provided with a controller (not shown) which operates a pull cord (not shown) so as to control movement of the shading member 10.

The bottom rail 20 is integrally formed by an aluminum extruding working process and has two opposite sides each provided with a receiving groove 25. The upper end of the bottom rail 20 is provided with a mounting slot 22 mounted on the lower end of the shading member 10. The mounting slot 22 of the bottom rail 20 has a top provided with a passage 21 to allow passage of the lower end of the shading member 10. The mounting slot 22 of the bottom rail 20 is defined by two substantially U-shaped guide rails 26, and the passage 21 of the bottom rail 20 is located between the two guide rails 26. The lower end of the bottom rail 20 is provided with a locking slot 23. The locking slot 23 of the bottom rail 20 has a substantially oblong cross-sectional profile and has a bottom provided with an entrance 24 which has a width smaller than that of the locking slot 23. The locking slot 23 of the bottom rail 20 is defined by a hollow protrusion 27 extending upward from the lower end of the bottom rail 20.

The lower end of the shading member 10 is provided with a mounting plate 12 inserted into the mounting slot 22 of the bottom rail 20 when the bottom rail 20 is mounted on the lower end of the shading member 10. The mounting plate 12 of the shading member 10 is limited by the two guide rails 26 of the bottom rail 20.

The upper end of the pull bar 40 is provided with a locking head 41 extending through the entrance 24 of the bottom rail 20 into the locking slot 23 of the bottom rail 20 and locked in the locking slot 23 of the bottom rail 20. The locking head 41 of the pull bar 40 has a substantially oblong cross-sectional profile corresponding to that of the locking slot 23 of the bottom rail 20. The locking head 41 of the pull bar 40 has a length equal to the width of the locking slot 23 of the bottom rail 20 and greater than the width of the entrance 24 of the bottom rail 20 and has a width equal to that of the entrance 24 of the bottom rail 20 and smaller than that of the locking slot 23 of the bottom rail 20. The locking head 41 of the pull bar 40 is provided with two opposite flattened faces 42, and a distance between the two flattened faces 42 of the locking head 41 is smaller than the width of the entrance 24 of the bottom rail 20 to allow insertion of the locking head 41 of the pull bar 40 through the entrance 24 of the bottom rail 20 into the locking slot 23 of the bottom rail 20.

The window covering further comprises two end caps 30 mounted on two opposite ends of the bottom rail 20 to cover the two opposite ends of the bottom rail 20 and to limit the lower end of the shading member 10. Each of the two end caps 30 has a cross-sectional profile corresponding to that of the bottom rail 20 and is provided with two protruding posts 31 each inserted into the respective receiving groove 25 of the bottom rail 20.

Figure 2:
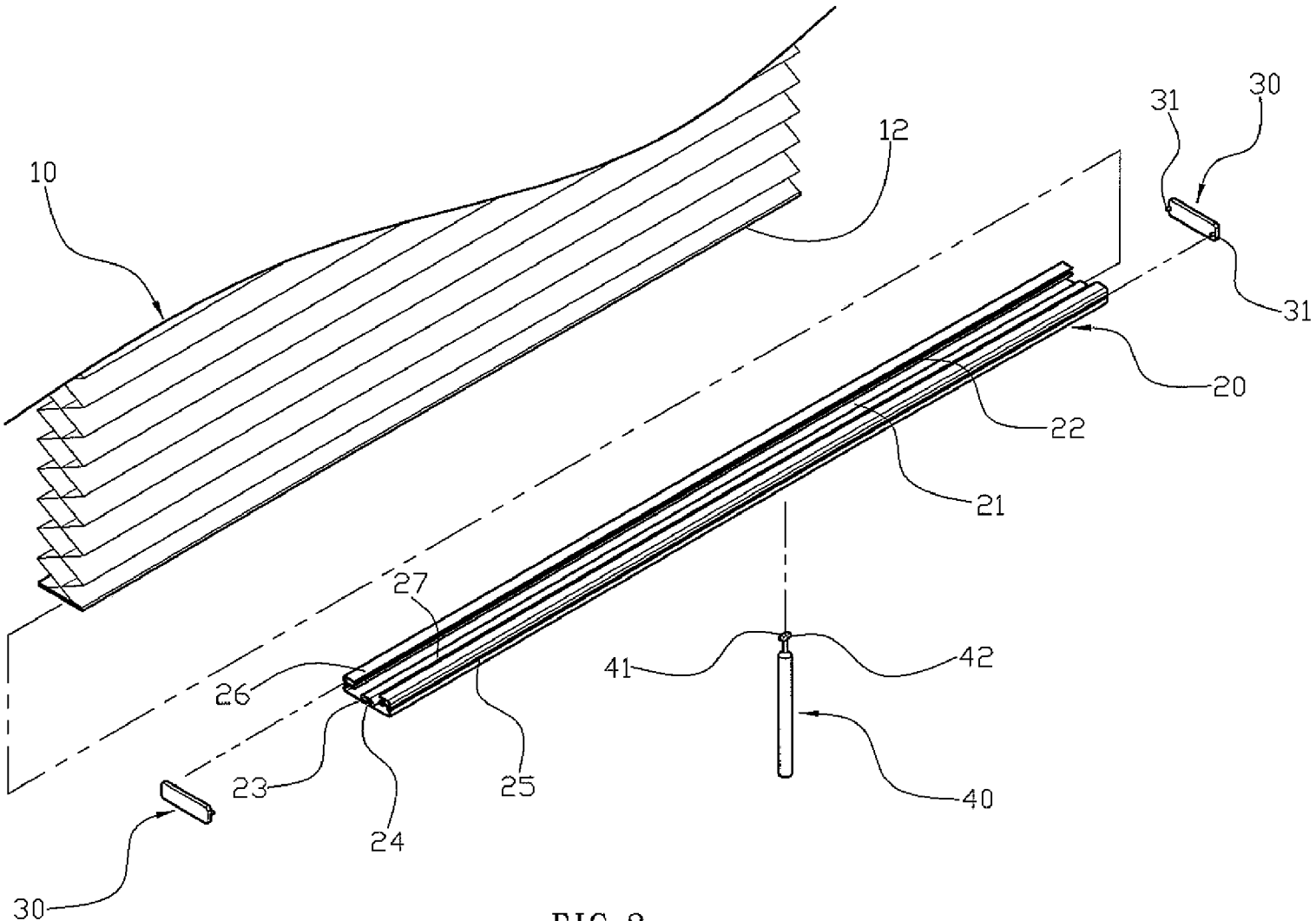
FIG. 2 is an exploded perspective view of the window covering as shown in FIG. 1.
Figure 3:
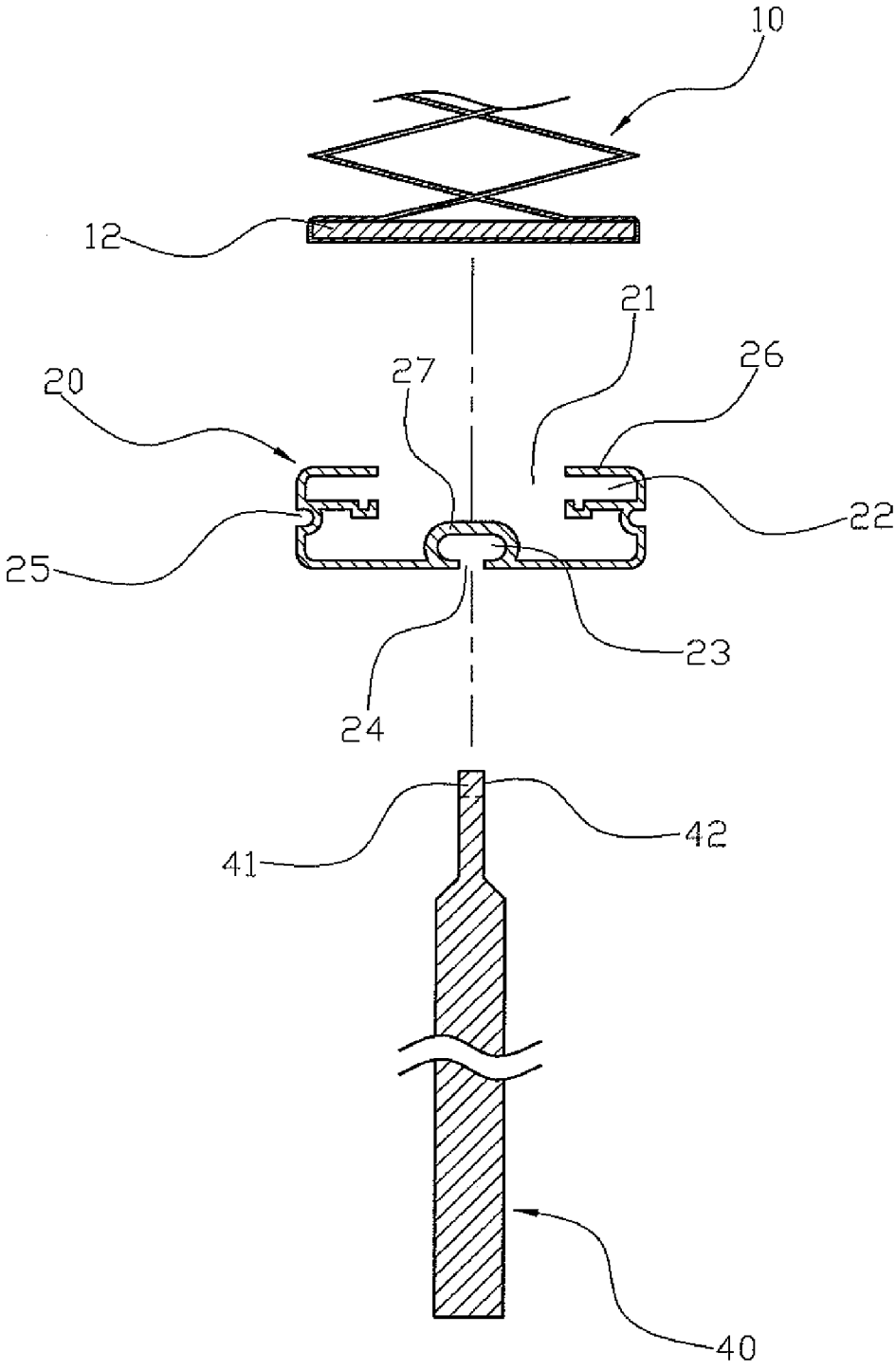
FIG. 3 is a side cross-sectional view of the window covering as shown in FIG. 2.
Figure 5:
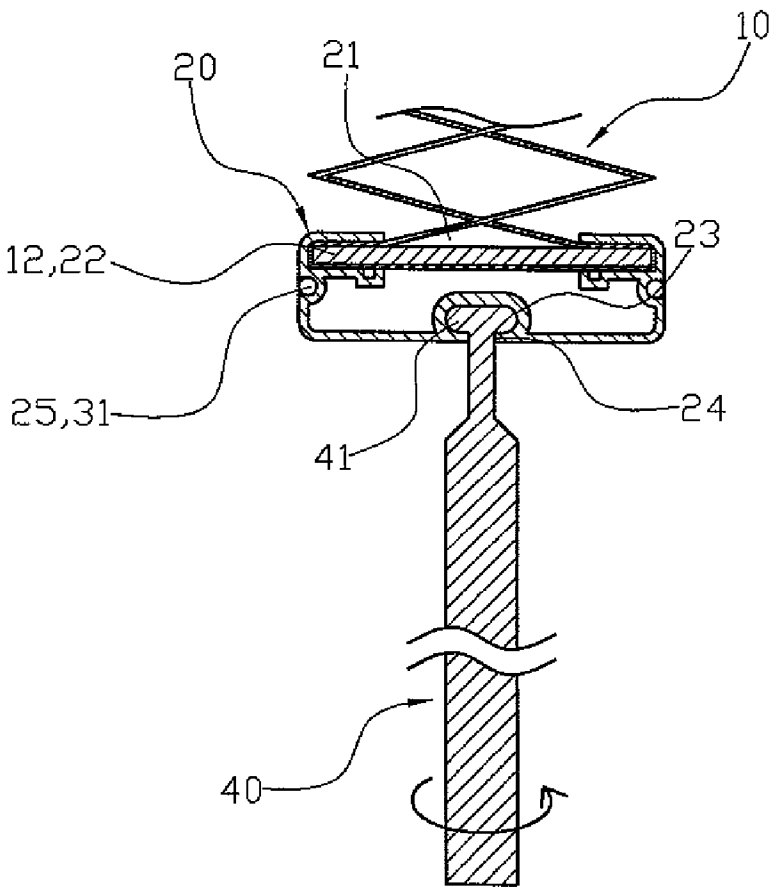
FIG. 5 is a schematic operational view of the window covering as shown in FIG. 4.
Figure 4:
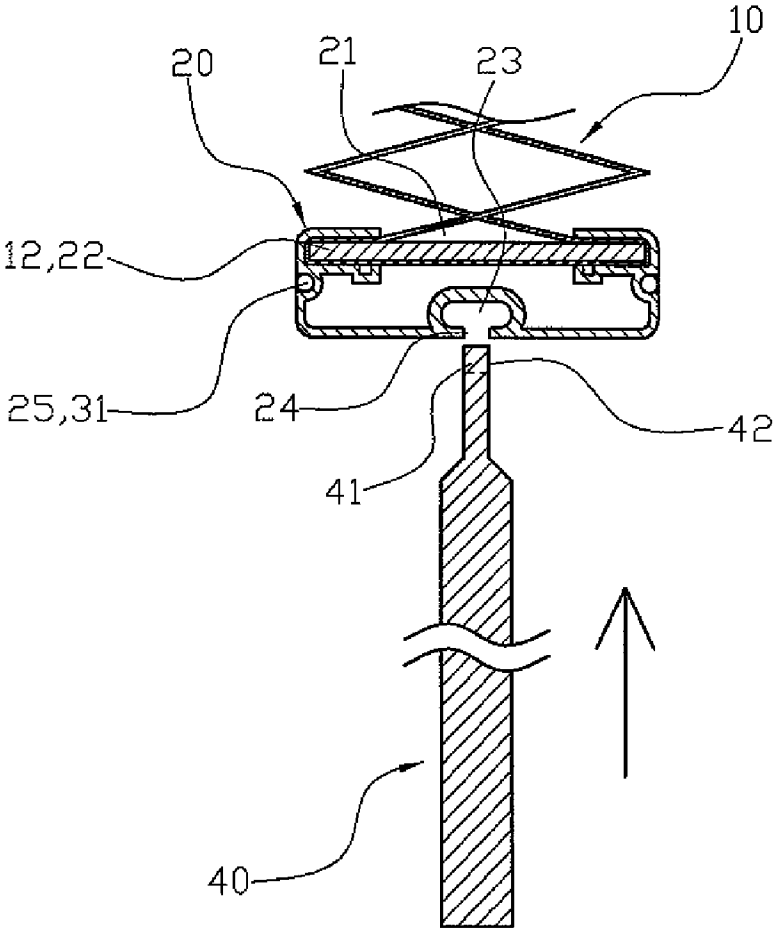
FIG. 4 is a schematic operational view of the window covering as shown in FIG. 3.

In assembly, referring to FIGS. 4 and 5 with reference to FIGS. 1-3, when the locking head 41 of the pull bar 40 is movable toward the bottom rail 20 as shown in FIG. 4, the two flattened faces 42 of the locking head 41 align with and extend through the entrance 24 of the bottom rail 20 into the locking slot 23 of the bottom rail 20. Then, the locking head 41 of the pull bar 40 is rotatable relative to the bottom rail 20 through ninety degrees as shown in FIG. 5, so that the two flattened faces 42 of the locking head 41 are separated from the entrance 24 of the bottom rail 20, and the locking head 41 of the pull bar 40 is flush with and locked in the locking slot 23 of the bottom rail 20 so as to lock the pull bar 40 onto the bottom rail 20.

On the contrary, the locking head 41 of the pull bar 40 is rotatable relative to the bottom rail 20 through ninety degrees in a reverse direction to unlock the locking head 41 of the pull bar 40 from the locking slot 23 of the bottom rail 20 and to align the two flattened faces 42 of the locking head 41 with the entrance 24 of the bottom rail 20, so that the locking head 41 of the pull bar 40 can be detached from the entrance 24 of the bottom rail 20 so as to remove the pull bar 40 from the bottom rail 20.

Figure 6:
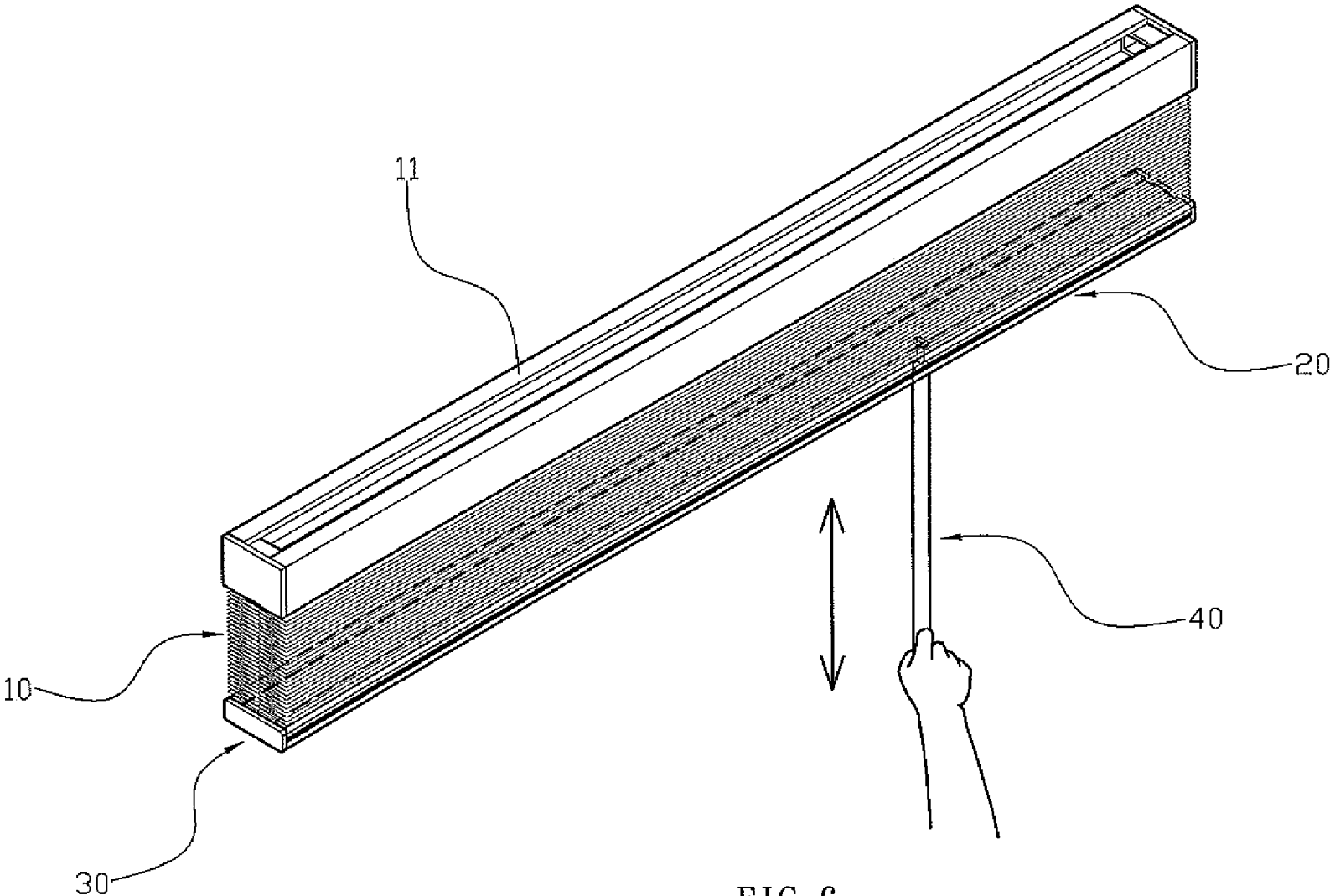
FIG. 6 is a schematic operational view of the window covering as shown in FIG. 1.

As shown in FIG. 6, the pull bar 40 is combined with the bottom rail 20 so that the bottom rail 20 is driven by the pull bar 40 to move upward or downward and to push the shading member 10 upward or pull the shading member 10 downward so as to fold or expand the shading member 10.

Accordingly, the pull bar 40 is combined with the bottom rail 20 to drive the bottom rail 20 to move upward or downward and to push the shading member 10 upward or pull the shading member 10 downward so as to fold or expand the shading member 10 so that the window covering needs not to provide a lift cord to push or pull the shading member 10 so as to provide a safety function. In addition, the pull bar 40 can be detached from the bottom rail 20 when not in use, thereby enhancing the aesthetic quality of the window covering. Further, the pull bar 40 is mounted on and detached from the bottom rail 20 by rotation of the pull bar 40, so that the pull bar 40 can be mounted on and detached from the bottom rail 20 easily and quickly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A window covering, comprising:

a headrail;

a retractable shading member having an upper end mounted on the headrail;

a bottom rail having an upper end mounted on a lower end of the shading member;

a pull bar having an upper end removably mounted on a lower end of the bottom rail to move the bottom rail and the shading member relative to the headrail;

wherein the shading member is movable with the bottom rail by movement of the pull bar and is positionable at a determined position when the pull bar and the bottom rail stop moving so as to freely adjust a distance between the headrail and the bottom rail;

the upper end of the bottom rail is provided with a mounting slot mounted on the lower end of the shading member;

the lower end of the shading member is provided with a mounting plate inserted into the mounting slot of the bottom rail in a longitudinal direction of the mounting slot of the bottom rail when the bottom rail is mounted on the lower end of the shading member;

the mounting slot of the bottom rail is defined by two substantially U-shaped guide rails;

the mounting plate of the shading member is limited by the two guide rails of the bottom rail;

the mounting plate of the shading member has two opposite sides each fully surrounded by a respective one of the two guide rails of the bottom rail;

the lower end of the bottom rail has a middle position provided with a locking slot which extends in a longitudinal direction of the bottom rail;

the locking slot of the bottom rail has a bottom provided with an elongate entrance which has a width smaller than that of the locking slot;

the entrance of the bottom rail extends in the longitudinal direction of the bottom rail and has a length equal to that of the locking slot of the bottom rail;

the upper end of the pull bar is provided with a locking head extending through the entrance of the bottom rail into the locking slot of the bottom rail and locked in the locking slot of the bottom rail;

the locking slot of the bottom rail has a substantially oblong cross-sectional profile;

the locking slot of the bottom rail is defined by a hollow protrusion extending upward from the lower end of the bottom rail into the upper end of the bottom rail;

the locking head of the pull bar has a substantially oblong cross-sectional profile corresponding to that of the locking slot of the bottom rail;

the locking head of the pull bar is fully hidden in the locking slot of the bottom rail and surrounded by a periphery of the locking slot of the bottom rail;

the locking head of the pull bar has a length equal to the width of the locking slot of the bottom rail and greater than the width of the entrance of the bottom rail;

the locking head of the pull bar has a width equal to that of the entrance of the bottom rail and smaller than that of the locking slot of the bottom rail;

the locking head of the pull bar is provided with two opposite flattened faces;

a distance between the two flattened faces of the locking head is smaller than the width of the entrance of the bottom rail to allow insertion of the locking head of the pull bar through the entrance of the bottom rail into the locking slot of the bottom rail;

the window covering further comprises two end caps mounted on two opposite ends of the bottom rail to cover the two opposite ends of the bottom rail and to limit the lower end of the shading member;

the bottom rail has two opposite sides each having an outside provided with a receiving groove which has an opening directed outward relative to the bottom rail;

each of the two end caps is provided with two protruding posts each inserted into the respective receiving groove of the bottom rail;

the two flattened faces of the locking head align with and extend through the entrance of the bottom rail into the locking slot of the bottom rail;

the locking head of the pull bar is rotatable relative to the bottom rail through a determined angle, so that the two flattened faces of the locking head are separated from the entrance of the bottom rail, and the locking head of the pull bar is flush with and locked in the locking slot of the bottom rail so as to lock the pull bar onto the bottom rail.

2. The window covering in accordance with claim 1, wherein the mounting slot of the bottom rail has a top pro vided with a passage to allow passage of the lower end of the shading member.

3. The window covering in accordance with claim 1, wherein the passage of the bottom rail is located between the two guide rails.

4. The window covering in accordance with claim 1, wherein each of the two end caps has a cross-sectional profile corresponding to that of the bottom rail.

* * * * *